United States Patent [19]

Roth et al.

[11] 4,443,285

[45] Apr. 17, 1984

[54] TAPERED ARTICLE LABELLING MACHINE AND METHOD

[75] Inventors: William F. Roth; Nevin Snyder, both of Hanover, Pa.

[73] Assignee: New Way Packaging Machinery, Inc., Hanover, Pa.

[21] Appl. No.: 386,253

[22] Filed: Jun. 8, 1982

[51] Int. Cl.[3] ..... B65C 3/12; B65C 9/04

[52] U.S. Cl. ..... 156/215; 156/453; 156/455; 156/485; 156/564; 156/567; 156/573; 156/578; 156/DIG. 11; 156/DIG. 26; 156/DIG. 27

[58] Field of Search ..... 156/215, 308.2, 451, 156/453, 455, 485, 564, 567, 573, 578, 542, DIG. 11, DIG. 13, DIG. 26, DIG. 27

[56] References Cited

U.S. PATENT DOCUMENTS

| | | | |
|---|---|---|---|
| 1,413,590 | 4/1922 | Kallenbach | 100/144 |
| 1,567,149 | 12/1925 | Kallenbach | 100/144 |
| 2,495,174 | 1/1950 | McClatchie | 156/451 |
| 2,626,075 | 1/1953 | Hesson | 156/363 |
| 2,722,333 | 11/1955 | Hesson | 156/363 |
| 2,925,931 | 2/1960 | Carter | 156/567 |
| 3,162,115 | 12/1964 | Bauer | 101/39 |
| 3,183,138 | 5/1965 | Mattingly et al. | 156/573 |
| 3,398,678 | 8/1968 | Usko | 101/38 R |
| 4,239,570 | 12/1980 | Kerwin | 156/542 |
| 4,338,155 | 7/1982 | Buchele | 156/567 |

*Primary Examiner*—Michael G. Wityshyn
*Attorney, Agent, or Firm*—Samuel M. Learned, Jr.

[57] ABSTRACT

A tapered article labelling machine and method providing the capability for automated high-speed accurate register continuous application of generally crescent shaped labels to curved and tapered articles, including auxiliary sub-assembly machine stations for accomplishing continuous tapered article infeed, adhesive application and label feed and application respectively to the sidewall surface thereof, label compression after adhesive application to accomplish label conformation to the tapered article exterior sidewall supporting surface during adhesive set, and thereafter automatic delivery of labeled articles from the machine to inspection and cartoning stations or the like.

10 Claims, 7 Drawing Figures

TAPERED ARTICLE LABELLING MACHINE AND METHOD

BACKGROUND OF THE INVENTION

The instant invention relates to a tapered article labelling machine and the method provided thereby for high-speed accurate-register continuous application of generally crescent shaped labels to a successive stream of curved and tapered articles in the form of frusto-conical cans or containers, and for the purposes of illustration and discussion herein the curved and tapered article shown is represented by that type of seamless metal container and structure presently being manufactured and popularly used for the packing of fish such as tuna or salmon, and the specific illustration of such a container and discussion thereof as herein presented is to be regarded as exemplary only and not limiting of the type of tapered article that may be labeled by said machine and method.

Under the circumstances of current and increasing competitive conditions in all areas of business activity, and particularly in the food processing industry it is incumbent upon operators to reduce as much as possible contributing cost factors such as those incurred in the shipment of empty food containers to processing plant locations. In a continuing effort to minimize empty container shipment costs many such containers are now made of aluminum to reduce shipment weight, and now many are also formed in tapered configuration so the empty containers are not only lighter but may be "nested" for shipment thereby also reducing the shipping volume. Although shipping cost and convenience advantages are realized as aforementioned in the use of tapered containers, the application of label indicia thereto up to the time of instant machine and method invention has been slow and costly thereby defeating the shipping cost and convenience advantages otherwise obtained.

In the past tapered food containers and the label indicia therefor was first printed in a generally crescent shaped layout on a flat piece of metal, then die-cut in a crescent form from the flat piece and thereafter formed into a cylindrical tapered shape with the ends thereof joined by a seam along the side along with the bottom. After being thus formed, nesting of the containers for shipment generally resulted in scratching and marring of the printed label.

With the advent of the use of various plastic materials in accomplishing high-speed formation of seamless tapered and curved containers, such as disposable drinking cups and cottage cheese containers, a printing method and apparatus for applying ink to the curved and tapered surfaces thereof by holding and axially rotating the empty tapered article in tangential rolling contact with a rotating plate was developed, generally as respectively taught in U.S. Pat. No. 3,398,678 to Usko dated Aug. 27, 1968, and U.S. Pat. No. 3,162,115 to Bauer dated Dec. 22, 1964. Although the rotating plate printing technique of tapered container labelling was satisfactory in terms of quality, again, the process was slow and costly and thus neutralized the other cost savings advantages gained by using tapered containers, and did not accommodate the labelling of containers filled with product.

Other types of irregularly shaped cylindrical containers such as perfume bottles and the like had pre-printed die cut adhesived paper or metallic labels applied thereto by means of a machine having a rotating platform somewhat similar to that of the instant machine invention, but however, provided with a plurality of radially extending jaws in which bottles with such adhesively applied labels were then separately clamped to provide compression during adhesive set, being as taught in U.S. Pat. No. 1,413,590 to Kallenbach dated Apr. 25, 1922, and U.S. Pat. No. 1,567,149 also to Kallenbach dated Jan. 11, 1924.

With respect to glue supply and application mechanisms and label feed means as pertains to the instant machine invention, the respective teachings of Hesson as set forth in U.S. Pat. No. 2,626,075 dated Jan. 20, 1953, and his later issued U.S. Pat. No. 2,722,333 dated Nov. 1, 1955, are pertinent and exemplary.

It should be understood that some of the features of the instant invention have, in some respects as to both machine and the method provided thereby certain structural and functional similarities to teachings separately set forth in the prior art disclosures heretofore cited and briefly discussed. However, as will be hereinafter pointed out, the instant invention in both machine and method is distinguishable from said earlier inventions in one or more ways in that the present invention has utility features and new and useful advantages, applications, and improvements in the art of tapered article labelling machines and methods not heretofore known.

SUMMARY OF THE INVENTION

It is the principal object of the present invention to provide a tapered article labelling machine and method for accomplishing the high-speed accurate-register continuous application of generally crescent shaped labels respectively to each of a successive plurality of curved and tapered articles such as frusto-conical cans or containers or the like.

It is another object of the present invention to provide a tapered article labelling machine having means for automatically feeding and advancing into the machine in spaced relation tapered articles for application of labels respectively thereto.

Still another object of the present invention is to provide a tapered article labelling machine which accomplishes a high-speed accurate-register application of labels without the kinking or wrinkling thereof.

It is a further object of the present invention to provide a tapered article labelling machine which is adapted to accomplish high-speed accurate register application of labels to tapered articles by adhesive affixment means employing either a hot melt adhesive or a cold glue or a combination of both.

It is yet another object of the present invention to provide a tapered article labelling machine having means to automatically secure a label in place upon a tapered article and compressively communicate and conform the same in registered affixment thereto during adhesive set.

It is also an object of the present invention to provide a tapered article labelling machine which is mechanically simple and highly reliable in operation, safe and easily maintained, and capable of being operated by one not possessed of special skills or training.

Details of the foregoing objects and of the invention, as well as other objects thereof, are set forth in the following specification and illustrated in the accompanying drawings comprising a part thereof.

DETAILED DESCRIPTION OF THE INVENTION

Figure 1:
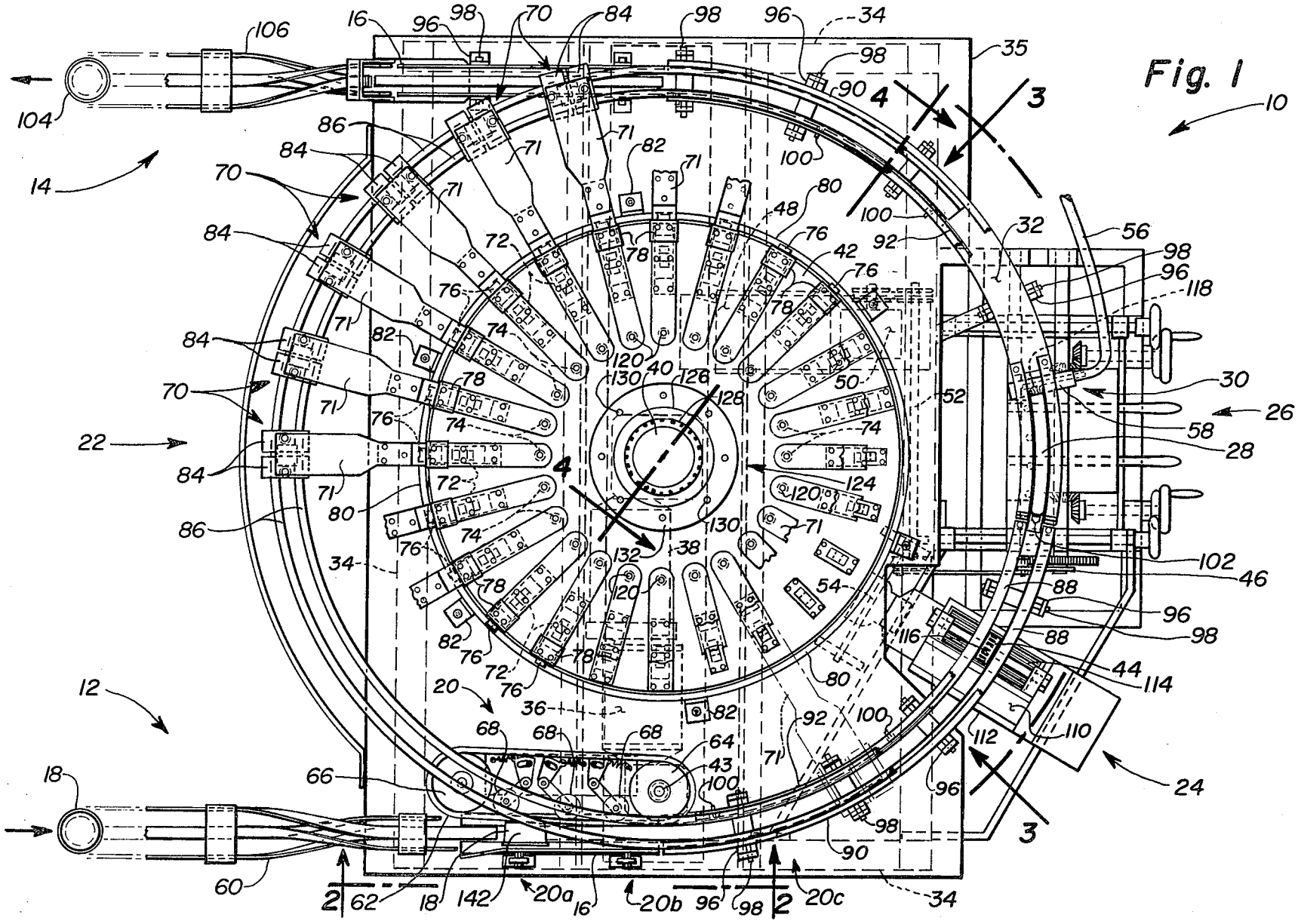
FIG. 1 is a top plan view of the tapered article labelling machine comprising the instant invention, illustrated with various of the plurality of radially extending arm members thereof being progressively cut away to better show various of the mechanically cooperative sub-assembly stations of said machine.

Referring to FIG. 1, the present invention is shown which comprises a tapered article labelling machine 10 having an infeed end 12 and a delivery end 14 interconnected by a tapered article arcuate guide track 16 adapted at the infeed end 12 to receive and thereafter direct exemplary tapered articles 18 progressively into and through said machine 10 for label application, first involving sequentially and mechanically the automatic compressive engagement of one of a plurality of said tapered articles respectively at the tapered article pick-up and spacing station 20 by communicative action of the differential speed cam cycled turntable mounted radial arm conveyor assembly 22 in thereafter accelerating each of the tapered articles thus engaged to an extendible spaced relationship one to the other in rapid succession and then conveyably driving the same within said guide track 16 at a constantly maintained high-speed rotational forwarding respectively thereof over the sidewall adhesive application station 24 which applies a pattern of suitable adhesive material to the external sidewall surface of said tapered article immediately thereafter followed by a label feed station 26 which holds and upwardly supplies successively from a pile crescent-shaped labels 28 the uppermost label of which on said pile is adhered respectively to each successive tapered article adhesived external sidewall surface as the same is rotatably conveyed thereacross, next followed by a label tail tab adhesive application station 30 to accommodate secure affixment of the label tail tab overwrap, and lastly the tapered article 18 with label 28 thus adhesively applied thereto is rotatably forwarded at continued constant high-speed within said guide track 16 across the arcuate label compression table 32 thus effecting impressed registered affixment respectively of a label 28 to an article 18 prepatory to forwarded delivery end 14 exit thereof in completed accomplishment of automated high-speed accurate register continuous label application to tapered articles by employment of the machine and method hereof.

Referring again to FIG. 1 to describe in greater detail the component parts of this invention as well as explain the cooperative operation thereof, wherein is shown the interconnected horizontal and vertical member supporting frame structure 34 within and upon which the various drive and operational assemblies of said machine 10 are positioned and secured in relative mechanical and functional spatial relationship one to the other therein or upon the main base table 35 supported thereon, further wherein the main drive motor 36 operating by direct drive through the main drive turntable transmission 38 delivers variable speed rotational drive power to the turntable drive shaft 40 which in turn imparts variable high-speed rotary motion to the turntable 42 to which is assembled the aforementioned cam cycled turntable mounted radial arm conveyor assembly 22 whereby said tapered articles 18 are successively engaged at the tapered article pick-up and spacing station 20 also powered off the main drive motor 36 through right angle gear box drive shaft 43 and thereafter rotationally propelled through said machine 10 in accomplishing high-speed labelling operations. The sidewall adhesive application cylinder 44 and the label feed station automatic label elevation mechanism 46 are both powered by an auxiliary sub-assembly drive motor 48 coupled through the auxiliary sub-assembly transmission 50 whereby rotational drive is imparted to the primary auxiliary sub-assembly power train drive shaft 52 for operation of the label feed station 26, and the extended angularly coupled secondary auxiliary sub-assembly power train drive shaft 54 for operation of the sidewall adhesive application cylinder 44. The label tail tab adhesive application station 30 employs a cold resin adhesive which is fed under pressure through adhesive feed line 56 to the cold resin adhesive distribution and tail tab application manifold 58.

In the immediate foregoing respect, it should be noted that both the sub-assembly structure and operation of the sidewall adhesive application station 24 are respectively those of a standard hot-melt system, having been long and well known in the art. The same is likewise true with respect to the sub-assembly structure and operation of the label tail tab adhesive application station 30 for a standard pressurized cold resin system. As pertains to the label feed station 26, except for being adapted to receive, hold, and feed crescent-shaped labels that sub-assembly also as to structure and function is old and well known in the art. Accordingly, further description of the subject sub-assemblies 24, 26, and 30 will not be detailed except as may otherwise hereinafter be necessary to further explain cooperative combination aspects thereof with inventive portions of the instant machine and method.

In machine 10 use application being initiated upon main drive motor 36 powering the turntable 42, coupled to and rotationally operated by the turntable drive shaft 40, is displaced in counterclockwise direction thus operating the cam cycled turntable mounted radial arm conveyor assembly 22 also in a counterclockwise rotational direction at relatively high speed, and the tapered article pick-up and spacing station 20 operable off the right angle gear box drive shaft 43 is likewise rotated in a counterclockwise direction but at a differentially slower relative rotational displacement speed than that of said conveyor assembly 22 whereby initial infeed engagement and thereafter accelerated spacing conveyance of tapered articles 18 along the tapered article guide track 16 is accomplished in the following manner. As illustrated in FIG. 1, tapered articles 18 are successively delivered to the infeed end 12 of said machine 10 in an upright disposition and thereupon cycled through an infeed delivery twist chute 60 to thereafter be positioned in a side configuration with the top or larger diameter of the tapered article 18 radially outward facing from the machine 10 turntable drive shaft 40 center location. At this point a tapered article thus delivered to machine 10 infeed staging is frictionally engaged centrally intermediate along the bottom end planar diameter dimension surface thereof by the differentially slower counterclockwise rotating tapered article pick-up drive belt 62 and thereby infed propelled to said machine 10 along and within the tapered article arcuate guide track 16. It will be noted that the tapered article pick-up drive belt 62 is backed along the tapered article engagement side surface thereof between the drive pulley 64 and idler pulley 66 by a plurality of outward urging pivotally operable spring biased idler rollers 68 whereby initial and continued frictional engagement of said tapered article 18 during movement thereof into and through the pick-up and spacing station 20 as above described is enabled, and as a tapered article 18 is thus engaged it is accelerated at low speed away from the successive back-up of similar such tapered articles extending through the infeed delivery twist chute 60 outwardly from the infeed staging area and spaced apart therefrom prepatory to subsequent high-speed engagement and acceleration by the cam cycled turntable mounted radial arm conveyor assembly 22.

The cam cycled turntable mounted radial arm conveyor assembly 22 is the primary operational group of said instant machine 10 invention and is comprised of a radial array of cam cycled spring biased pivot arm assemblies 70 each having a pivot arm 71 respectively connected centrally intermediate thereof by means of a pivot bracket 72 and inwardly at the inside end proximity thereof by a compression spring guide bolt assembly 74 all connectably arrayed so that each such said pivot arm 71 is disposed at equally spaced regularly repeating arcuate distance displacements one to the other to and about the turntable 42, wherein each such pivot arm 71 further mounts just outward of the turntable 42 periphery a cam follower 76 by means of a cam follower bracket assembly 78 therefor whereby continuous spring biased pivotal contact of each cam follower 76 respectively of each of said cam cycled spring biased pivot arm assemblies 70 of said radial array with a radial variable elevation cam 80 assembled by means of cam elevation adjustment brackets 82 to the main base table 35 upward surface operates to simultaneously provide upon arcuate rotational displacement of said turntable 42 cam cycled variable elevation disposition to the other end respectively of each such said pivot arm 71 each in turn thereon mounting proximity the outside end thereof a set of spring biased pivotally operable conveyor belt connecting leaves 84 which in combination with the remainder of said array function to clamp and hold a spaced set of inverted V-belt members 86 that form the radially operable high-speed conveyor of said assembly 22.

When the pick-up and spacing station 20 is engaging and delivering tapered articles from the infeed staging area at low-speed acceleration into machine 10 along the tapered article arcuate guide track 16 thereof as above described, proximity the mid-point arcuate dimension of said pick-up and spacing station 20 the inverted V-belt members 86 of the differential high-speed counterclockwise rotating cam cycled turntable mounted radial arm conveyor assembly 22 sequentially engage in turn the foremost leading tapered article 18 compressively and resiliently along the upward facing external sidewall peripheral surface respectively thereof and thereupon rotationally accelerate the same to a constant higher speed extended space arcuate movement displacement distance along said tapered article arcuate guide track 16.

Accelerated tapered articles 18 for labelling, in rotational conveyance transport going forward from the infeed staging area through various processing operational stations of said machine 10 to the delivery 14 thereof, are registered and controlled by the tapered article arcuate guide track 16 as aforementioned, which is comprised in cooperative combination of the downwardly disposed arcuately elongated laterally spaced tapered article conveyance rails 88 upon which a tapered article 18 is supported in relative operational elevation disposition during conveyance through said machine 10. The head register rails 90 provide a constant arcuate lateral positioning of the tapered article planar top surface for purposes of adhesive application stations 24 and 30, and label feed station 26, adjustment and run sets. In order that constant head register positioning is maintained a spring biased flexible ribbon arcuate compression rail 92 operates to provide a constant outward slidably resilient lateral pressure engagement force along the tapered article planar bottom surface.

The tapered article conveyance rails 88 of said guide track 16 are supported in elevated disposition above the main base table 35, and connectably assembled thereto, by means of conveyance rail connecting Posts 94 which are not shown in FIG. 1 but seen in FIG. 2 and certain subsequent Figures hereof to be hereinafter discussed. The head register rails 90 and the flexible ribbon arcuate compression rail 92 are supported in upward disposed laterally spaced arcuate relationship by means of the side rail support and adjustment brackets 96 with the head register rails 90 being assembled thereto by means of slot engaging compression stud members 98 and the flexible ribbon arcuate compression rail 92 being assembled thereto in opposing inward spaced lateral disposition by means of deflectable compression spring stud members 100.

As tapered articles 18 are first engaged and accelerated forward in the manner above described the initial expanse of said tapered article arcuate guide track 16 serves as a raceway along and within which said engaged tapered articles are brought to operational spacing one with respect to the other next successively following, which is variable but fixed at a minimum arcuate distance established by the longitudinal arcuate head-to-tail dimension of the particular crescent shaped labels 28 of that lot being run, and the operational spacing of such tapered articles at accelerated axial rotation run speed within said guide track 16 along the aforementioned raceway expanse portion thereof as cooperationally fed thereto by the tapered article pick-up and spacing station 20 and thereafter accelerated to a constant run speed and spacing by the cam cycled turntable mounted radial arm conveyor assembly 22 is first established minimally at the longitudinal arcuate head-to-tail label dimension or slightly in excess thereof by variably adjusting as appropriate the speed of the main drive motor 36, which then becomes the machine 10 base run speed for that particular tapered article labelling job. Once that base run speed is established generally by the foregoing method, then the auxiliary sub-assembly drive motor 48 is adjusted so that the sidewall adhesive application station 24 and the label feed station 26 run speeds are operationally balanced to the tapered article axial rotation displacement base run speed.

The operationally accelerated and spaced tapered articles 18 sequentially rotate over the sidewall adhesive application cylinder 44, respectively axially rotating at balanced run speed, during which a pattern of hot melt adhesive is printed thereby circumferentially to the external sidewall surface of the tapered article 18 rotationally conveyed thereacross. Immediately following sidewall adhesive application, the tapered article 18 is rotationally moved in continued constant high-speed forwarding by said cam cycled turntable mounted radial arm conveyor assembly 22 to the label feed station 26 where the label feed head elevator and tail adhesive applicator trigger 102 is engaged by the tapered article sidewall surface which thereupon indexes upward the uppermost label leading edge back side surface to engage the hot melt adhesived tapered article sidewall surface and be rotationally peeled away from the label pile by adhesion thereto as the tapered article 18 is rotationally elevated in continued conveyable flexible ribbon arcuate compression rail 92 urged slidable head registered rotational transit along an upward inclined portion of the tapered article conveyance rails 88. It should here be noted, although not shown in FIG. 1, that the arcuate elevation profile of said radial variable elevation cam 80 corresponds generally to that of the tapered article conveyance rails 88 at the sidewall adhesive application station 24 and elsewhere thereby providing continuous resilient rotational tracking drive with respect to said tapered articles 18 by said cam cycled turntable mounted radial arm conveyor assembly 22 during label application processing operation high-speed rotational displacement thereof through said machine 10.

As the tapered articles 18 successively peel-adhere sequentially a crescent shaped label 28 each to the peripheral sidewall surface respectively thereof by the method hereof as thus far described, the tapered article 18 rotationally advances past the label tail tab adhesive application station 30 and in so doing over-wraps the adhesived tail tab for secure total tapered article sidewall surface label adhesion. At this point of arcuate processing transport the now labeled tapered article 18 rotationally passes over the arcuate label compression table 32 which serves to provide a label-to-adhesive-to-tapered article sidewall surface conforming contact as said tapered article 18 is rotationally forwarded in continued conveyable transport thereacross.

The remainder of machine 10 conveyance displacement distance, both arcuate and tangential along the tapered article arcuate guide track 16 following the arcuate label compression table 32 through the delivery end 14, provides an adhesive set duration transit sufficient such that as labeled tapered articles 104 exit from the machine 10 delivery twist chute 106 they may thereafter be immediately cartoned or otherwise handled without special precautions other than those normally exercised under such circumstances.

Preferably, the machine 10 as disclosed in FIG. 1 is constructed of various metals and alloys, but other suitable materials or combinations thereof as appropriate may be used.

Figure 2:
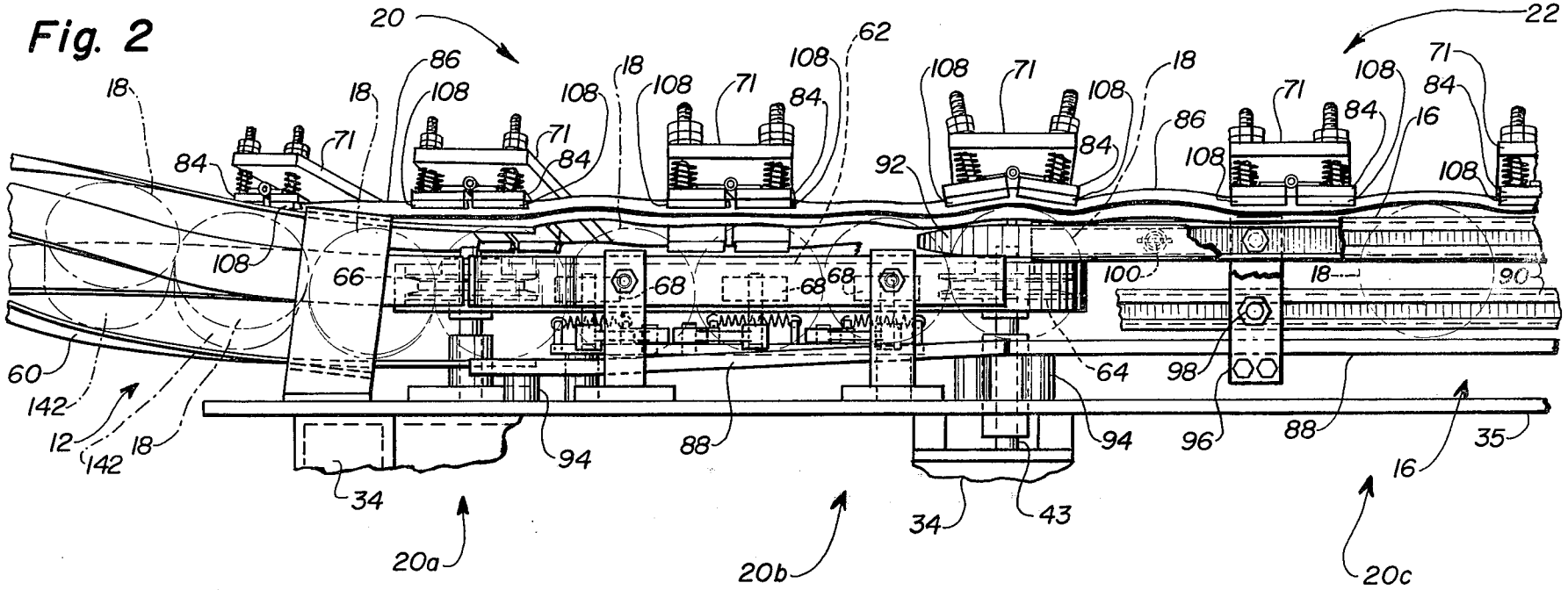
FIG. 2 is an enlarged side elevation of the tapered article infeed and spacing sub-assembly station of said machine shown in FIG. 1 as seen along the line 2—2 thereof.

Referring now to FIG. 2, which is an enlarged side elevation of the tapered article pick-up and spacing station 20 as seen generally along the line 2—2 of FIG. 1, wherein is shown greater mechanical and operational detail thereof as well as more specific illustration of the manner and mechanism whereby tapered articles 18 are engaged in compressive resilience by the inverted V-belt members 86 of the cam cycled turntable mounted radial arm conveyor assembly 22 for accelerated tapered article 18 spacing and high-speed rotational transport forwarding thereof.

As illustrated in FIG. 2, the exemplary tapered articles 18 are delivered to the tapered article pick-up and spacing station 20 in a contiguous sidewall-to-sidewall stream during which transit the same are rotated on forward feeding through said twist chute 60 from top upward configuration to top radial outward configuration as progressively shown. At tapered article infeed pick-up position **20*a* the bottom side external planar surface of each tapered article 18 is engaged compressively by the tapered article pick-up drive belt 62 and thereafter forwarded along the tapered article arcuate guide track 16 by the machine 10 conveyance system to the tapered article infeed spacing position 20*b* where the tapered article 18 infeed conveyance transition from pick-up drive belt 62 forwarding to cam cycled turntable mounted radial arm conveyor assembly 22 accelerated axial rotation and spaced forwarding of said tapered articles 18 respectively and sequentially to a constant high-speed arcuate processing displacement along said tapered article arcuate guide track 16 of said machine 10 is accomplished. Also shown in greater detail in FIG. 2 are the pivotally operable spring biased idler rollers 68 of the tapered article pick-up and spacing station 20 whereby constant frictional drive force pressure is caused to be urged by the face of said pick-up drive belt 62 against the bottom planar contact surface of said tapered articles 18**.

At the tapered article infeed spacing position **20*b* cooperative operation of the flexible ribbon arcuate compression rail 92 in providing slidable resilient bottom planar surface pressure against said tapered articles 18 to constantly maintain forwarding head register thereof for accuracy in accomplishing and during subsequent labelling operations is shown. Additionally shown in FIG. 2 vicinity of the tapered article infeed spacing position 20*b* is action of the spring biased pivotally operable conveyor belt connecting leaves 84 of the compound pivot arm 71 whereby resilient radially conformed arcuate axial rotation accelerated drive and spacing is imparted to and maintained upon said tapered articles 18 in conveyance transition through and forward from said infeed spacing position 20*b*. It will be noted that during accelerated axial radial rotation forwarding, when a tapered article 18 external sidewall circumferential surface transitionally underlies the spring biased pivotally operable conveyor belt connecting leaves 84, said leaves pivotally flex under compressive spring pressure to conform the inverted V-belt members 86 so that the contact surfaces thereof slightly wrap the external sidewall circumferential surface of said tapered article 18 to thus facilitate imparting and then maintaining accelerated high-speed axial rotation forwarding drive thereto. However, when the tapered article 18 external sidewall circumferential surface transitionally underlies an expanse of inverted V-belt members not underlying a compound pivot arm 71, as also shown in illustration of the spaced forwarded tapered article 18 accelerated disposition at position 20***c* in FIG. 2, then the spring biased pivotally operable conveyor belt connecting leaves 84 operate to downwardly press the compound pivot arm intermediate inverted V-belt member expanse resiliently in partial wrap-around against the tapered article 18 external sidewall circumferential surface to also impart and maintain from acceleration high-speed axial rotation forwarding drive thereto.

As also shown in FIG. 2, the inverted V-belt members 86 are secured to the spring biased pivotally operable conveyor belt connecting leaves 84 by means of spaced sets of wedged belt cleats 108 connectably assembled thereto, the wedge holding mechanism of said cleats 108 being more clearly illustrated in FIG. 4 hereof to be more fully detailed hereinafter.

Figure 3:
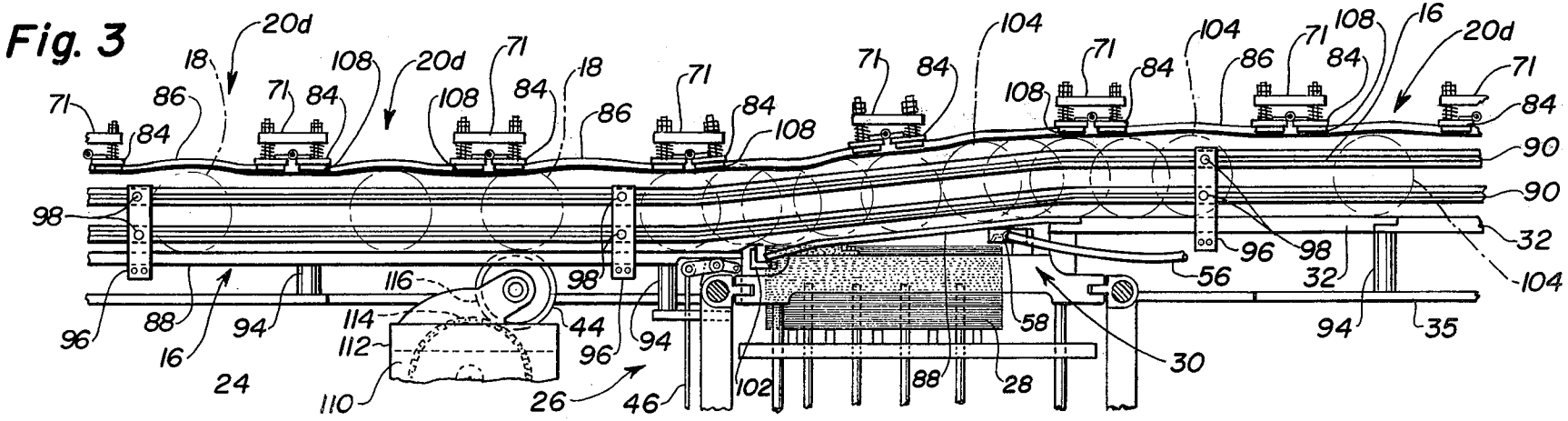
FIG. 3 is an enlarged flattened plane side elevation of the adhesive application and label feed sub-assembly station of said machine shown in FIG. 1 as seen along the arcuate line 3—3 thereof.

In FIG. 3 an enlarged side elevation of the spaced constant high-speed forwarded tapered article disposition 20*d* entering the sidewall adhesive application station 24, and in progressive forwarded phantom illustration thereafter through the label feed station 26 for pick-up and circumferential tapered article 18 sidewall surface application respectively of a crescent shaped label 28 and then through the label tail tab adhesive application station 30 to provide labeled tapered articles 104, by the machine and method of instant invention, is shown.

As shown in FIG. 3, adhesive 110 contained in an adhesive reservoir 112 of the sidewall adhesive application station 24 is rotationally picked up by a ribbed cylinder 114 thereof to transfer an alternating bar adhesive pattern 116 to the tapered article sidewall adhesive application cylinder 44 which in turn prints said alternating bar adhesive pattern 116 to the external circumferential sidewall surface of said tapered article 18 as the same is axially rotated at spaced constant high-speed 20*d* in head registered disposition thereacross, which adhesive pattern 116, being preferably a hot melt, serves as the pick-up medium whereby the uppermost crescent shaped label 28 upon the pile thereof at the label feed station 26 is peeled from said pile and circumferentially wrapped progressively about the tapered article 18 adhesived sidewall surface during continued forwarding transit 20*d* within confines of the tapered article arcuate guide track 16.

As previously described a pattern of tail wrap adhesive 118, preferably a cold resin glue, has been applied by the label tail tab adhesive application station 30 simultaneous with the crescent shaped label 28 pick-up peeling from said pile thereof as above described, which tail wrap adhesive 118 serves to secure the label in tail tab overwrap unto itself as the then labeled tapered article 104 proceeds in continued forwarding to the arcuate label compression table 32 over which secured conformation of the adhesive applied label to the tapered article 18 external circumferential sidewall surface is accomplished.

Figure 4:
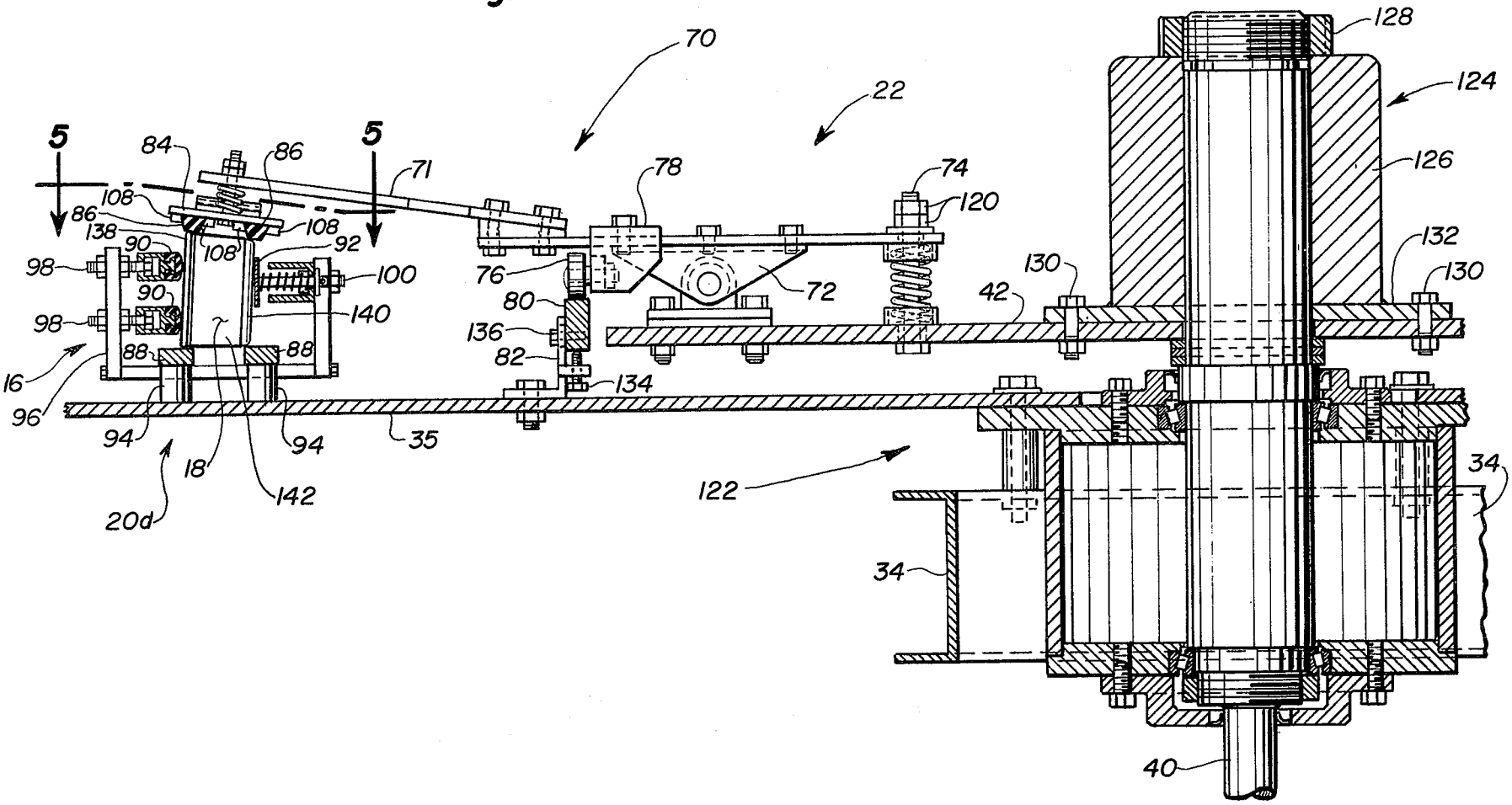
FIG. 4 is an enlarged side elevation of one of the radially extending arm members of said machine and the rotational drive attachment means therefor shown in FIG. 1 as seen along the line 4—4 thereof.

The view in FIG. 4 is an enlarged side sectional elevation of the cam cycled turntable mounted radial arm conveyor assembly 22 showing in greater detail one of the plurality of cam cycled spring biased pivot arm assemblies 70 thereof. As shown, the arm assembly 70 is pivotally assembled to the turntable 40 by means of pivot bracket 72 and the compression spring guide bolt assembly 74 which in turn threadably mounts compression spring adjustment and lock set nuts 120 whereby pivotally deflectable arcuate displacement contact of the cam follower 76 with the radial variable elevation cam 80 is constantly maintained as well as also constant contact maintenance of the inverted V-belt members 86 with the tapered article 18 side surfaces through the additional conforming effect of the spring biased pivotally operable conveyor belt connecting leaves 84.

Additional mechanically cooperative structural detail of said machine 10 shown in FIG. 4 includes that of the turntable drive shaft bearing mounting assembly 122 connectably securing the same within the interconnected horizontal and vertical member supporting frame structure 34 and to the main base table 35, and thereabove in extended upward axially aligned connected disposition upon the turntable drive shaft 40 the turntable drive shaft collet assembly 124 wherein the collet housing 126 secured by the collet housing nut 128 to said drive shaft 40 and in turn by means of collet housing flange bolts 130 connectably joining the collet housing flange 132 to the turntable 42 through communicating openings respectively therein accommodates transmission of rotary drive motion from the main drive motor 36 to the cam cycled turntable mounted radial arm conveyor assembly 22.

As also shown in FIG. 4, the radial variable elevation cam 80 is assembled to the main base table 35 by means of the cam elevation adjustment brackets 82 as previously described, whereby cam 80 elevation is accomplished by cam elevation adjustment bolt 134 and once made is maintained by means of cam elevation adjustment set lock bolt 136.

Lastly shown in greater detail in FIG. 4 are the structural configurations and relative spatial relationships of the spring biased pivotally operable conveyor belt connecting leaves 84 mounting the inverted V-belt members 86 to the head register rails 90 and in turn to the flexible ribbon arcuate compression rail 92 one operationally to the other and to an exemplary tapered article 18 during machine 10 processing operation.

Figure 5:
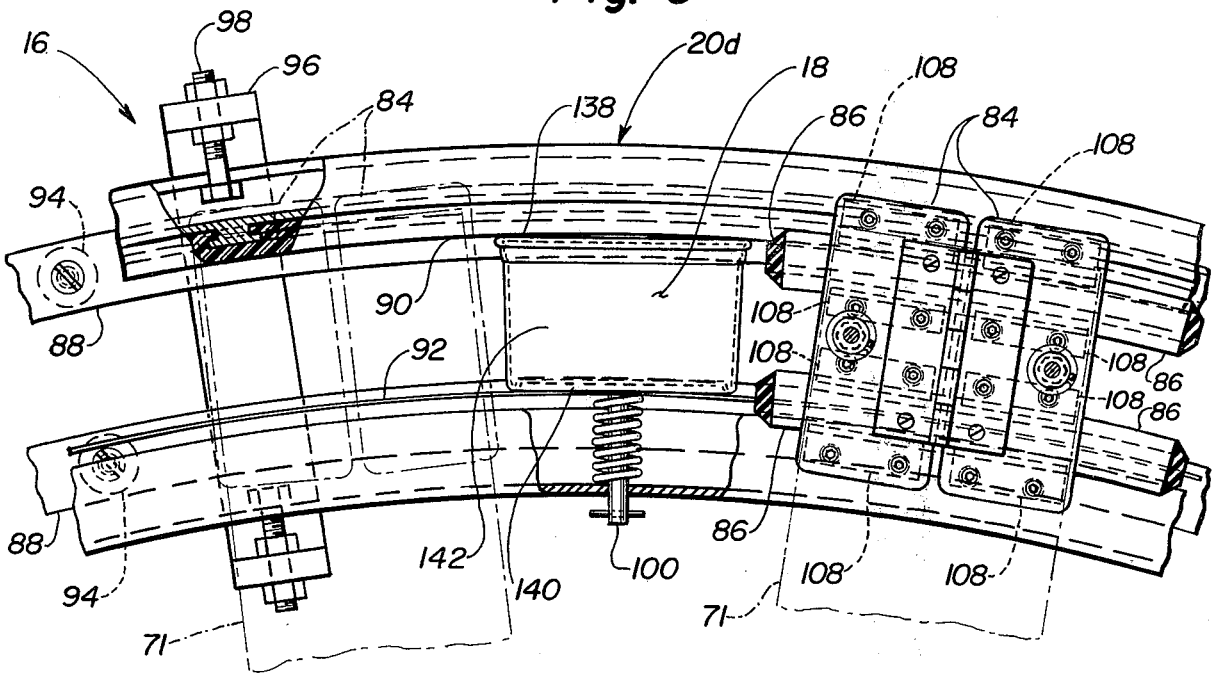
FIG. 5 is an enlarged top plan view of the radially extending arm member tapered article compression and drive sub-assembly shown in FIG. 4 as seen along the line 5—5 thereof.

In FIG. 5 greater top plan detail of the operational relationships of the inverted V-belt members 86 and the head register rails 90 and flexible ribbon arcuate compression rail 92 are shown, and more particularly that each respectively as either a tapered article 18 conveyance drive or control means engages said tapered article 18 either along the top rim 138 in the case of the head register rail 90 and one of the inverted V-belt members 86, or along the bottom rim 140 as in the case of the flexible ribbon arcuate compression rail 92 and the other of the inverted V-belt members 86, thereby leaving unobstructed the peripheral sidewall surface 142 of said tapered article 18 for accomplishment of label application processing operations by the method and machine 10 of instant invention.

Figure 6:
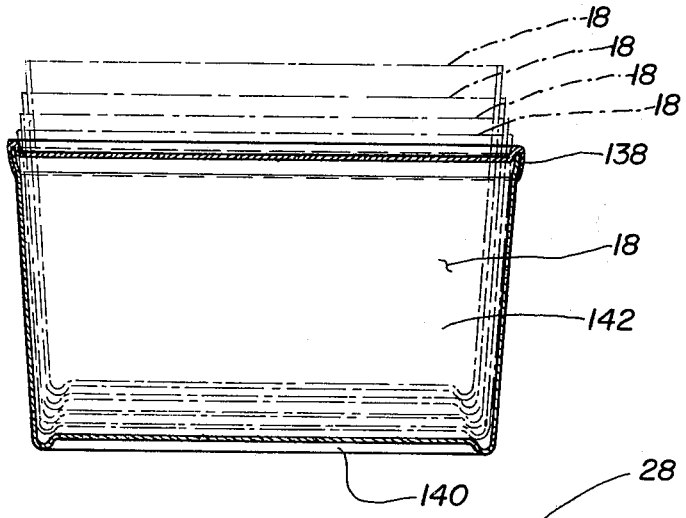
FIG. 6 is an enlarged side elevation of an exemplary tapered article suitable for label application by the machine and method hereof.
Figure 7:
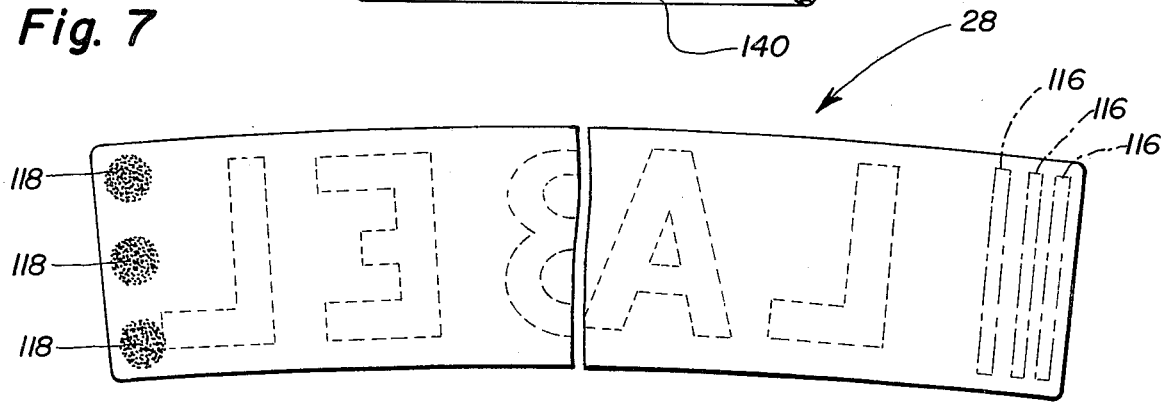
FIG. 7 is an enlarged side elevation of an exemplary generally crescent shaped label applied by said machine and method hereof to an exemplary tapered article as shown in FIG. 6.

Considering lastly FIGS. 6 and 7 together, being respectively those of an exemplary tapered article 18 as shown in FIG. 6 and in phantom therein illustration of the technique of nesting such articles when empty for economy and convenience in cartoning and shipping, and in FIG. 7 an exemplary crescent shaped label 28 corresponding to that which would be applied by the method and machine 10 of instant invention to the exemplary tapered article 18 illustrated in FIG. 6. Also shown in FIG. 7 are the relative configurations on the exemplary crescent shaped label 28 of the alternating bar adhesive pattern 116 and the tail wrap adhesive pattern 118 respectively applied thereto as previously described.

Although the invention and method thereof have been herein shown and described in what are conceived to be the most practical and preferred embodiments, it is recognized that departures may be made respectively therefrom within the scope of the invention, which is not to be limited to the details disclosed herein but is to be accorded the full scope of the claims so as to embrace any and all equivalent devices, apparatus, and methods.

We claim:

1. A tapered article labelling machine operable to receive, reposition, space, accelerate, and thereafter compressively engage and forward at a high-speed circumferentially rotated displacement for automatic label application processing a successive stream of curved and tapered frusto-conical articles respectively having a peripheral sidewall surface in turn respectively enclosably supporting a top rim and a bottom rim structurally disposed in a plannar parallel spaced relationship one to the other, said machine comprising in combination:

a. a support frame having interconnected horizontal and vertical members adapted to mount a horizontally disposed turntable rotationally driven by a motor through an interconnecting vertically disposed turntable drive shaft assembled the radial center axis of said turntable, b. an infeed end provided with an infeed delivery twist chute adapted to up-end turn each respective curved and tapered frusto-conical article of said successive stream from a top rim upward facing horizontal disposition to a top rim turntable radial center axis outward facing vertical disposition for arcuate peripheral sidewall surface circumferential rotary motion transport upon a tapered article arcuate guide track provided with a tapered article registration means therealong in effecting label application processing displacement therefrom to a delivery end, c. a tapered article pick-up and spacing station adapted to receivably engage said up-end turned tapered articles successively from said infeed delivery twist chute and acceleratedly space the same in an extendible relationship one to the other in continued forward feeding peripheral sidewall surface circumferential rotary motion transport upon said arcuate guide track, d. a rotationally operational radial arm conveyor assembly mounted upon said turntable and adapted by a camming means and a cooperative inverted V-belt compression means to progressively engage concurrently said tapered articles respectively along the up-end turned top rim and bottom rim peripheral surfaces thereof and circumferentially rotate said acceleratedly spaced articles along said tapered article guide track at a constant high-speed displacement forwarding to the delivery end of said machine within the confines of said registration means therealong, e. an adhesive application station positioned along said tapered article arcuate guide track intermediate said infeed end and said delivery end and adapted to apply between said top rim and said bottom rim to the external circumferential sidewall surface respectively of each of a curved and tapered frusto-conical article in the succession comprising said stream an adhesive, and f. a label application station positioned along said tapered article arcuate guide track intermediate said adhesive application station and said delivery end and adapted to automatically present and apply between the top rim and the bottom rim a label to the external circumferential adhesived sidewall surface respectively of each of said curved and tapered frusto-conical articles during continued constant high-speed radial arm conveyor assembly circumferential rotary motion and transport thereof.

2. The machine according to claim 1 in which said curved and tapered frusto-conical articles labeled thereby are food containers.

3. The machine according to claim 1 in which said adhesive applied thereby is a hot melt.

4. The machine according to claim 1 in which said label applied thereby is crescent shaped.

5. The machine according to claim 1 in which said tapered article registration means is a flexible ribbon arcuate compression rail.

6. The machine according to claim 5 in which said flexible ribbon arcuate compression rail is spring biased.

7. The machine according to claim 6 being provided with a second adhesive application station positioned along said tapered article arcuate guide track intermediate said label application station and said delivery end and adapted to apply to the tail tab interior surface of said label a second adhesive.

8. The machine according to claim 7 in which said second adhesive applied thereby is a cold resin.

9. The machine according to claim 8 being provided with a label compression table station positioned along said tapered article arcuate guide track first ahead of said delivery end of said machine and adapted to compressively conform respectively said label to said sidewall surface circumferentially intermediate said top rim and said bottom rim of said curved and tapered frusto-conical article.

10. A method of labelling curved and tapered frusto-conical articles, said method comprising first conveyably repositioning said articles from a top rim and a bottom rim horizontal plane disposition to a top rim and a bottom rim vertical plane disposition for access presentment of the tapered sidewall surface thereof for label application processing and thereafter engaging and sequentially spacing apart respectively in an extended rotation displacement circumferentially about the curved and tapered sidewall surface thereof along an arcuately configured guide track with an individual curved and tapered article from a like successive contiguously abutted stream thereof sequentially delivered thereto, second accelerating each of said sequentially spaced apart individual curved and tapered articles to a constant high-speed circumferentially rotated displacement forwarding along said arcuately configured guide track, next applying an adhesive material to the external circumferential sidewall surface between the top rim and the bottom rim of each of said constantly high-speed circumferentially rotated curved and tapered articles during continued forwarding displacement respectively thereof along said arcuately configured guide track, and thereafter followed by circumferentially rotational engagement and adhered external circumferential sidewall surface wrapping of a label upon said curved and tapered article between the top rim and the bottom rim thereof by means of said adhesive material previously applied thereto.

* * * * *